US006045632A

United States Patent [19]

Sun et al.

[11] Patent Number: 6,045,632

[45] Date of Patent: Apr. 4, 2000

[54] METHOD FOR MAKING CAN END AND TAB STOCK

[75] Inventors: Tyzh-Chiang Sun, Danville; William M. Betts, Pleasanton, both of Calif.

[73] Assignee: Alcoa, Inc., Pittsburgh, Pa.

[21] Appl. No.: 09/015,422

[22] Filed: Jan. 29, 1998

Related U.S. Application Data

[63] Continuation-in-part of application No. 08/538,415, Oct. 2, 1995, Pat. No. 5,772,802.

[51] Int. Cl.[7] ..... C22F 1/04

[52] U.S. Cl. ..... 148/551; 148/552; 148/692; 148/695; 148/700; 148/702

[58] Field of Search ..... 148/550, 551, 148/552, 692, 693, 695, 700, 702

[56] References Cited

U.S. PATENT DOCUMENTS

| | | | |
|---|---|---|---|
| 4,235,646 | 11/1980 | Neufeld et al. | 148/551 |
| 4,282,044 | 8/1981 | Robertson et al. | 148/551 |
| 4,582,541 | 4/1986 | Dean et al. | 148/551 |
| 4,976,790 | 12/1990 | McAuliffe et al. | 148/551 |
| 5,104,465 | 4/1992 | McAuliffe et al. | 148/439 |
| 5,106,429 | 4/1992 | McAuliffe et al. | 148/551 |
| 5,110,545 | 5/1992 | McAuliffe et al. | 420/534 |
| 5,192,378 | 3/1993 | Doherty et al. | 148/691 |
| 5,356,495 | 10/1994 | Wyatt-Mair et al. | 148/551 |
| 5,469,912 | 11/1995 | McAuliffe et al. | 164/476 |
| 5,470,405 | 11/1995 | Wyatt-Mair et al. | 148/551 |
| 5,514,228 | 5/1996 | Wyatt-Mair et al. | 148/551 |
| 5,531,840 | 7/1996 | Uesugi et al. | 148/552 |
| 5,772,802 | 6/1998 | Sun et al. | 148/551 |

FOREIGN PATENT DOCUMENTS

| | | | |
|---|---|---|---|
| 0640694 | 3/1995 | European Pat. Off. | C22C 21/00 |
| WO 94/19129 | 9/1994 | WIPO | B22D 11/06 |

OTHER PUBLICATIONS

ASM Handbook, vol. 4, 1991, Heat Treating of Nonferrous Alloys, 860–866.

*Primary Examiner*—George Wyszomierski
*Attorney, Agent, or Firm*—Jones, Tullar & Cooper

[57] ABSTRACT

End or tab stock and a method for its manufacture in which a low alloy content aluminum alloy is continuously cast to form a hot feedstock, the hot feedstock is rapidly quenched rapidly to prevent substantial precipitation of alloying elements, annealed, quenched, and coiled. The can end and tab stock of the invention has strength and formability equal to higher alloy content aluminum alloy.

23 Claims, 3 Drawing Sheets

TWIN BELT HEAT SINK CASTER

METHOD FOR MAKING CAN END AND TAB STOCK

This application is a continuation-in-part of U.S. Ser. No. 08/538,415, filed Oct. 2, 1995, now U.S. Pat. No. 5,772,802.

FIELD OF THE INVENTION

The present invention relates to a process for making can end and tab stock for aluminum alloy beverage containers. More particularly, the present invention relates to a continuous process for making such end and tab stock, which is more economical and efficient.

BACKGROUND OF THE INVENTION

It is now conventional to manufacture beverage containers from aluminum alloys. An aluminum alloy sheet stock is first blanked into a circular configuration and then cupped. The side wall are ironed by passing the cup through a series of dies having diminishing bores. The dies thus produce an ironing effect which lengthens the sidewall to produce a can body thinner in dimension than its bottom.

Thus, formability is a key characteristic of aluminum alloy to be used in manufacturing cans. Such cans are most frequently produced from aluminum alloys of the 3000 series. Such aluminum alloys contain alloy elements of both magnesium and manganese. In general, the amount of manganese and magnesium used in can body stock is about 1% by weight.

In the manufacture of complete "two-piece" aluminum beverage containers, it has been the practice in the industry to separately form the bodies, top ends and tabs. Such ends and tabs are then shipped to the filler of the beverage can and applied once the containers have been filled. The requirements for can ends and tabs are generally quite different than those for can bodies. In general, greater strength is required for can ends and tabs, and that requirement for greater strength has dictated that such can ends and tabs be fabricated from a aluminum alloy different from that used in can bodies. One such alloy commonly used is alloy AA5182, which contains relatively high amounts of magnesium to provide the added strength and formability necessary for can ends and tabs. AA5182 typically contains magnesium in an amount of about 4.4% by weight, thus adding to the cost of the alloy for can ends and tabs.

Alloys from the 3000 series, such as AA3104, have been proposed in the fabrication of can ends and tabs. When can ends are fabricated from AA3104 they require a greater thickness and thus are more expensive because such alloys generally have diminished strength and formability as compared to AA5182.

SUMMARY OF THE INVENTION

The present invention is the discovery that aluminum alloys containing lesser amounts of alloying elements can be used in fabricating can ends and tabs without sacrificing strength or formability. The alloy is made by utilizing a fabrication process in which it is formed into sheet stock for making can ends and tabs.

Accordingly, the present invention is a method for making can end and tab stock comprising the steps of: continuous casting an aluminum alloy to form a feedstock; quenching the feedstock; annealing the feedstock to effect recrystallization without causing substantial precipitation of alloying elements; quenching the feedstock; and coiling the feedstock at a temperature between 250° F. and 550° F. The preferred method further comprises hot rolling the feedstock after the continuous casting step and final rolling the feedstock after the quench step to form a sheet. Preferably, the hot rolling temperature is between 500° F. and the solidus temperature of the feedstock and the annealing temperature is between 600° F. and 1100° F. Preferably, the sheet is coiled at a temperature between 300° F. and 475° F.

The preferred aluminum alloy contains 0 to about 0.6% by weight silicon, from 0 to about 0.8% by weight iron, 0 to about 0.6% by weight copper, about 0.2 to 1.5% by weight manganese, and about 0.2 to 2% by weight magnesium, with the balance being aluminum with its usual impurities.

It has been found that the intermediate annealing and quenching steps substantially improve the formability of the feedstock while maintaining exceptionally high metallurgical properties including ultimate tensile strength and yield strength.

It has been unexpectedly found that such a fabrication process provides an aluminum alloy feedstock having equal or better metallurgical and formability characteristics as compared to aluminum alloys conventionally used in forming can ends and tabs.

It has been found in accordance with the preferred embodiment of the present invention that the fabrication process can be applied to Al-Mg-Mn-Cu-Si alloys similar to AA3104 or UBS (used beverage can stock) without the need to increase the thickness of the can ends and tabs to achieve comparable strengths.

Without limiting the present invention as to theory, it is believed that the techniques of continuous or strip casting followed by quenching, annealing, quenching, and coiling provides an alloy sheet having improved strength by reason of solid solution and age hardening. The preferred process facilitates the rapid processing of the feed stock so that precipitation of alloying elements of intermetallic compounds is substantially minimized. In addition, without limiting the present invention as to theory, it is believed that formability of the sheet stock of this invention used in forming can ends and tabs is equal to or better than these DC-cast aluminum alloys containing greater quantities of alloying elements. Thus, the present invention allows can ends and tabs to be produced from less expensive aluminum alloys without sacrificing the metallurgical properties of those more expensive alloys. It has also been found that the anneal and quench steps promote the formability of the can end and tab stock without adversely effecting its strength.

This process has the further advantage of eliminating process and material handling steps typically employed in the prior art. The strip casting can be used to produce a cast strip having a thickness less than 1.0 inches, and preferably within the range of 0.05 to 0.2 inches, more preferably, within the range of 0.07 and 0.12 inches. In addition, in accordance with the most preferred embodiment of the invention, the widths of the strip is relatively narrow, which is contrary to conventional wisdom. The present width facilitates ease of in-line threading and processing and allows production lines for the manufacture of can end and tab stock to be physically located with or as part of a can end and tab making facility.

DETAILED DESCRIPTION OF THE INVENTION

Figure 1:
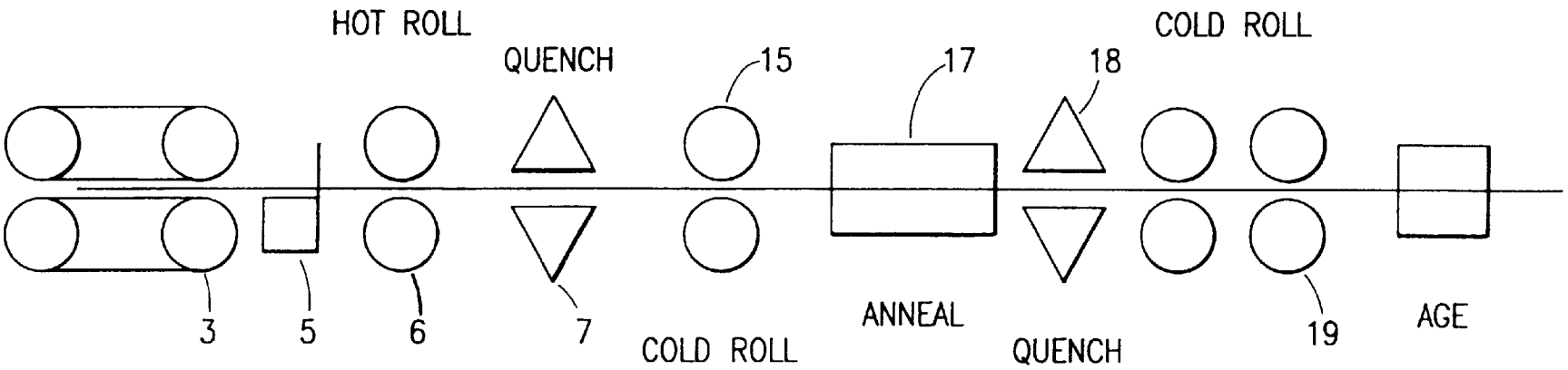
FIG. 1 is a schematic illustration of the continuous in-line sequence of steps employed in the practice of the invention.

The sequence of steps employed in the preferred embodiment of the invention are illustrated in FIG. 1. One of the advances of the present invention is that the processing steps for producing sheet stock can be arranged in one or two continuous in-line sequences. The preferred practice of the invention is in a relatively narrow width (for example, as narrow as 24 or 12 inches) makes it practical for the devices used in the present process to be of a relatively small size which can be conveniently and economically located in or adjacent to sheet stock customer facilities. In that way, the process of the invention can be operated in accordance with the particular technical and through-put needs for sheet stock users.

In the preferred embodiment, molten metal is delivered from a furnace (not shown in the drawing) to a metal degassing and filtering device to reduce dissolved gases and particulate matter from the molten metal, also not shown. The molten metal is immediately converted to a cast feedstock or strip 4 in casting apparatus 3.

The feedstock employed in the practice of the present invention can be prepared by any of a number of continuous casting techniques well known to those skilled in the art, including twin belt casters like those described in U.S. Pat. No. 3,937,270 and the patents referred to therein. In some applications, it may be preferable to employ as the technique for casting the aluminum strip the method and apparatus described in the following U.S. patents and applications which are hereby incorporated by reference in their entireties; U.S. Pat. Nos. 5,515,908, 5,564,491 and copending application Ser. No. 08/799,448.

Other casters may also be employed. For example, drum casters, such as that in U.S. Pat. Nos. 5,616,190 or 4,411,707 or block casters, such as that described in U.S. Pat. No. 5,469,912 may be employed to produce a feedstock. It is important that the II feedstock be continuously cast. The method described below is preferred. The above U.S. patents are hereby incorporated by reference in their entireties.

Figure 2:
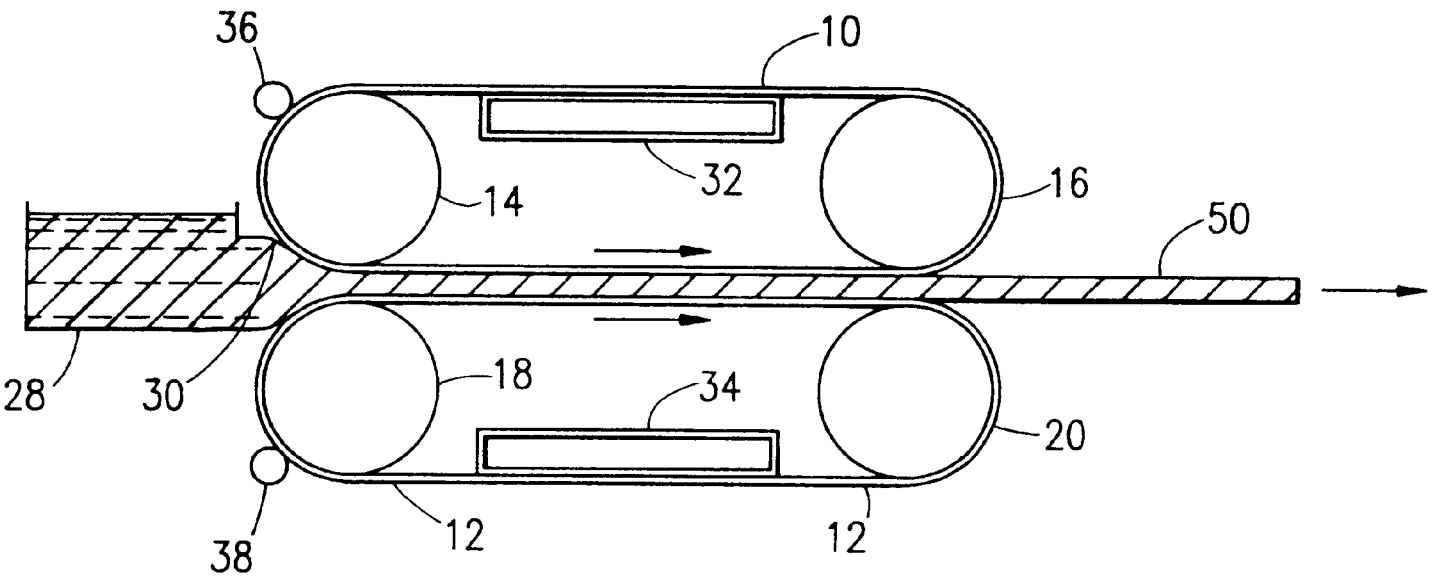
FIG. 2 is a schematic illustration of preferred strip casting apparatus used in the practice of the invention.

The preferred strip casting technique is illustrated in FIG. 2. The apparatus includes a pair of endless belts 10 and 12 carried by a pair of upper pulleys 14 and 16 and a pair of corresponding lower pulleys 18 and 20. Each pulley is mounted for rotation, and is a suitable heat resistant pulley. Either or both of the upper pulleys 14 and 16 are driven by suitable motor means or like driving means not illustrated in the drawing for purposes of simplicity. The same is true for the lower pulleys 18 and 20. Each of the belts 10 and 12 is an endless belt and is preferably formed of a metal which has low reactivity with the aluminum being cast.

The pulleys are positioned, as illustrated in FIG. 2, one above the other with a molding gap therebetween corresponding to the desired thickness of the aluminum strip being cast.

Molten metal to be cast is supplied to the molding gap through suitable metal supply means such as a tundish 28. The inside of the tundish 28 corresponds substantially in width to the width of the belts 10 and 12 and includes a metal supply delivery casting nozzle 30 to deliver molten metal to the molding gap between the belts 10 and 12.

The casting apparatus may include a pair of cooling means 32 and 34 positioned opposite that position of the endless belt in contact with the metal being cast in the molding gap between the belts. The cooling means 32 and 34 thus serve to cool belts 10 and 12, respectively, before they come into contact with the molten metal. In the preferred embodiment illustrated in FIG. 2, coolers 32 and 34 are positioned as shown on the return run of belts 10 and 12, respectively. In that embodiment, the cooling means 32 and 34 can be conventional cooling devices such as fluid nozzles positioned to spray a cooling fluid directly on the inside and/or outside of belts 10 and 12 to cool the belts through their thickness. Further details respecting an example cooling means may be found in U.S. Pat. No. 5,363,902 which is hereby incorporated by reference in its entirety.

Additionally, a cooling means may be built into the exit pulleys 16 and 20 in lieu of the cooling means described above as 32 and 34. These means will cool the belts from their inner surface as described in provisional application (7013.001).

Returning to FIG. 1, the feedstock 4 from the strip caster 3 is preferably moved through optional shear and trim station 5 into one or more hot rolling stands 6 where its thickness is decreased. Immediately after the hot rolling operation has been performed in the hot rolling stands 6, the feedstock is cooled or quenched to a temperature preferably less than 600° F. or 500° F., more preferably less than 400° F. and the coiled.

The cooling may be accomplished during rolling or by the addition of a separate quench step which is accomplished through the contact with a cooling substance, such as described below. For example, a quench station 8 can be used in which the feedstock is rapidly cooled or quenched by means of a cooling fluid. Because the feedstock is rapidly cooled in the quench station 8, there is insufficient time to cause any substantial precipitation of alloying elements from solid solution. Any of a variety of quenching stations may be used in the practice of this invention. Typically, the separate quenching station is one in which cooling fluid, either in liquid or gaseous form, is sprayed onto the hot feedstock to rapidly reduce its temperature. Suitable cooling fluids include water, air, gases such as carbon dioxide or nitrogen, lubricants used to cool the rolling mills, and the like. It is important that the quench be carried out quickly to reduce the temperature of the hot feed stock rapidly to prevent substantial precipitation of alloying elements from solid solution. Preferably, the feedstock will be passed to a rolling stand after the separate quench step.

Quenching may also be accomplished by any other method to reduce the temperature of the feedstock to prevent precipitation.

It will be appreciated by those skilled in the art that there can be expected some small precipitation of intermetallic compounds that does not specifically affect the final properties. Such minor precipitation has little or no affect on those final properties either by reason of the fact that the intermetallic compounds are of a volume and/or type which have a negligible effect on the final properties. As used herein, the term "substantial" refers to precipitation which affects the final sheet properties.

Figure 3:
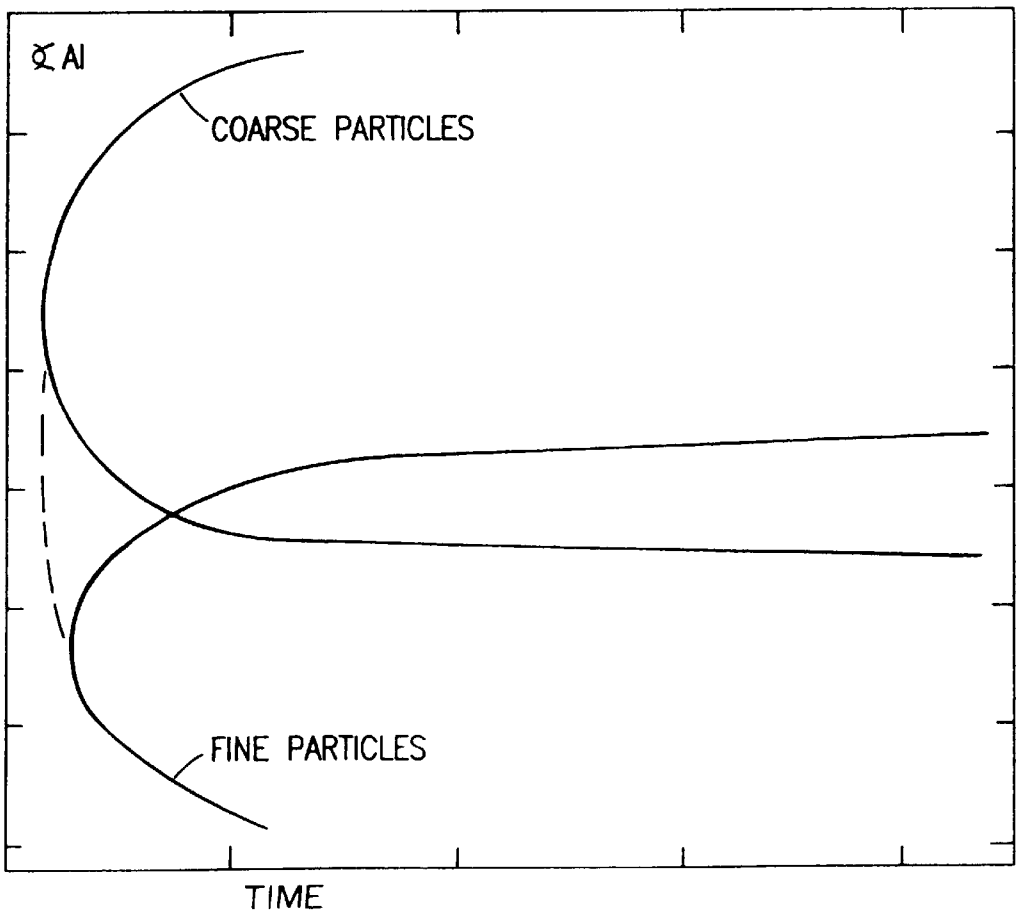
FIG. 3 is a generalized time temperature-transformation diagram for aluminum alloys illustrating how rapid heating and quenching serves to eliminate or at least substantially minimize precipitation of alloying elements in the form of intermetallic compounds.

The importance of rapid heating and quenching is illustrated by FIG. 3 of the drawings, a generalized graphical representation of the formation of precipitates of alloying elements as a function of time and temperature. Such curves, which are generally known in the art as time temperature-transformation or "C" curves, show the formation of coarse and fine particles formed by the precipitation of alloying elements as intermetallic compounds as an aluminum alloy is heated or cooled. Thus, the heating effected in the annealing step and the cooling effected by the quench operation immediately following annealing is effected at a rate such that the temperature-time line followed by the aluminum alloy during the heating and quenching remains between the ordinate and the curves. That ensures that heating and cooling is effected sufficiently rapidly so as to avoid substantial precipitation of such alloying elements as intermetallic compounds.

After coiling, the feedstock may be stored until needed for further processing, as described below. Alternatively, the coil may be immediately passed to an cold rolling stand 15 and then to a flash annealing furnace 17 in which the feedstock is rapidly heated and recrystallized. That rapid annealing step provides an improved combination of metallic properties such as grain size, strength and formability through recrystallization of the matrix and solution of some alloying elements. Because the feedstock is rapidly heated, substantial precipitation of other alloying elements is avoided. Thus the heating operations should be carried out to the desired annealing and recrystallization temperature such that the temperature-time line followed by the aluminum alloy does not cross the C-curves illustrated in FIG. 3 in such a way as to cause substantial precipitation.

The strip is again cooled or quenched immediately following the anneal step to a temperature suitable for final rolling. The methods described above for cooling/quenching are applicable for this step. Because the feedstock is rapidly cooled in the quench step 18, there is insufficient time to cause any substantial precipitation of alloying elements from solid solution.

In the present context, "final rolling" or rolling to final gauge means that rolling which occurs after the recrystallization anneal. Separate final rolling and quenching steps are necessary if an active quench step is used. As stated above, a rolling step may accomplish both tasks.

It is sometimes desirable, after rolling to final gauge to batch stabilize the cold-rolled strip at an elevated temperature, preferably at temperatures within the range of 220–400° F. for about 1 to about 10 hours. This batch stabilization precipitates intermetallic compounds in a strengthening form, and also increases formability through recovery of the aluminum matrix. More preferably, the strip can be stabilized at a temperature between 300 and 375° F. for between 1 and 4 hours. When the strip has been quenched immediately following annealing so as to substantially minimize precipitation of alloying elements as intermetallic compounds, the cast strip has an unusually high level of solute supersaturation. Thus, the stabilizing step causes the ultimate tensile strength and yield strength to increase along with formability (as measured by percent elongation in a tensile test, for example).

The preferred embodiment includes passing the continuously cast feedstock from the caster, hot rolling, quenching/cooling, rolling, coiling, uncoiling, rolling, annealing, quenching/cooling, final rolling and coiling the sheet. The entire process is performed in two steps. As stated above, the feedstock is coiled between the steps and can be stored as dictated by commercial requirements.

Preferably, the final sheet is coiled at an elevated temperature, with an upper limit of 550° F. or even 500° F. More preferably, the upper limit is 475° F. or 450° F. Preferably, the lower limit is 250° F., more preferably, the lower limit is 300° F., or even 325° F. A stabilizing step may not need to be employed after this higher temperature coiling.

Thereafter, the strip can either be stored until needed or it can be immediately formed into can ends and/or tabs using conventional techniques.

As will be appreciated by those skilled in the art, it is possible to realize the benefits of the present invention without carrying out all of the final (typically cold) rolling step as part of the second step of the process. The remainder of the final rolling step can be carried out in an off-line fashion, depending on the end use of the alloy being processed. As a general rule, carrying out the final rolling step off-line decreases the economic benefits of the preferred embodiment of the invention in which all of the process steps are carried out in-line. However, it may be advantageous for other reasons.

It has become the practice in the aluminum industry to employ wider cast strip or slab for reasons of economy. In the preferred embodiment of this invention, it has been found that, in contrast to this conventional approach, the economics are best served when the width of the cast feedstock 4 is maintained as a narrow strip to facilitate ease of processing and enable use of small decentralized strip rolling plants. Good results have been obtained where the cast feedstock is less than 24 inches wide, and preferably is within the range of 2 to 20 inches wide. By employing such narrow cast strip, the investment can be greatly reduced through the use of small, two-high rolling mills and all other in-line equipment. Such small and economic facilities of the present invention can be located near the points of need, as, for example, can end or tab fabrication facilities. That location has the further advantage of minimizing costs associated with packaging, shipping of products and customer scrap. Additionally, the volume and metallurgical needs of a can plant can be exactly matched to the output of an adjacent plant which uses the presently described process.

In the practice of the invention, the hot rolling exit temperature is generally maintained within the range of 500 to 1000° F. Hot rolling is typically carried out in temperatures within the range of 300° F. to the solidus temperature of the feedstock. Preferably, the upper temperature used in hot rolling is 900° F., or 850° F. More preferably, the upper limit is 800° F. Preferably, the lower temperature is 500° F., or 550° F. More preferably, the lower limit is 600° F.

The annealing step in which the feedstock is subjected to solution heat treatment to cause recrystallization is effected for less than 120 seconds, and preferably between 0.1 to 60 or 10 seconds. Preferably, the upper annealing temperature is 1100° F. More preferably, the upper limit is 1060° F. Preferably, the lower temperature is 800° F., or 850° F. More preferably, the lower limit is 900° F.

Preferably, the feedstock in the form of strip 4 is quenched to temperatures necessary to continue to retain alloying elements in solid solution, typically at temperatures less than 550° F.

As will be appreciated by those skilled in the art, the extent of the reductions in thickness effected by the hot rolling and final rolling operations of the present invention are subject to a wide variation, depending upon the types of alloys employed, their chemistry and the manner in which they are produced. For that reason, the percentage reduction in thickness of each of the hot rolling and final rolling operations of the invention is not critical to the practice of the invention. In general, good results are obtained when the hot rolling operation effects reduction in thickness within the range of 15 to 99% and the final rolling effects a reduction within the range from 10 to 85%.

Preferably, the sheet stock that is produced by this process is for end and tab stock, which is eventually used to make ends and tabs for aluminum beverage containers. Preferably, the present sheet stock has a maximum thickness of 0.014 inches, more preferably, the maximum thickness is 0.011 inches. Preferably, the present sheet stock has a minimum thickness of 0.0084 inches, more preferably, the minimum thickness is 0.0080 inches. It is known to those skilled in the art that these thicknesses will continue to decrease with time because of continuous downgauging of beverage cans.

As indicated, the concept of the present invention makes it possible to utilize, as sheetstock for fabricating can ends and tabs, aluminum alloys containing smaller quantities of alloying elements as compared to the prior art. As a general proposition, the concepts of the present invention may be applied to aluminum alloys containing less than 2% magnesium, such alloys would be similar to AA3104 and used beverage can stock. Because of the unique combination of processing steps employed in the practice of the invention, it is possible to obtain strength and formability levels with such low alloy content aluminum alloys that are equal to or better than the more expensive aluminum alloy heretofore used. In general, such alloys contain 0 to about 0.6% by weight silicon, from 0 to about 0.8% by weight iron, 0 to about 0.6% by weight copper, about 0.2 to 1.5% by weight manganese, and about 0.2 to 2% by weight magnesium, with the balance being aluminum with its usual impurities (classified as those elements which are present at a level of 0.05 wt % or lower). Preferably, the alloys contain 0.15 to about 0.5% by weight silicon, from 0.2 to about 0.5% by weight iron, from about 0.1 to about 0.6% by weight copper, about 0.5 to 1.2% by weight manganese, and about 0.5 to 2.0% by weight magnesium, with the balance being aluminum with its usual impurities.

In general, such aluminum alloys treated in accordance with the practice of the present invention have ultimate tensile strengths and greater than 50,000 psi. Preferably, the yield strengths are greater than 45,000 psi.

Having described the basic concept of the present invention, reference is now made to the following examples which are provided by way of illustration and not by way of limitation to the invention.

EXAMPLE 1

An aluminum alloy with the following composition was strip cast to a thickness of 0.090 inches using a continuous strip caster similar to that substantially shown and described in U.S. Pat. Nos. 5,515,908, 5,564,491 and copending application Ser. No. 08/799,448:

| Element | Percentage By Weight |
|---|---|
| Si | 0.3 |
| Fe | 0.45 |
| Cu | 0.2 |
| Mn | 0.90 |
| Mg | 0.80 |
| Aluminum and Impurities | Balance |

The hot cast strip was then immediately rolled to a thickness of 0.045 inches and heated for five seconds at a temperature of 1000° F. and immediately thereafter quenched in water. The feedstock was then rolled to a thickness of 0.0116 inches and stabilized at 320° F. for two hours at finish gauge. It had an ultimate tensile strength of 56,000 psi, a yield strength of 50,600 psi and 7.2% elongation.

EXAMPLE 2

An aluminum alloy with the following composition was strip cast to a thickness of 0.10 inches as described in the patents above;

| Element | Percentage By Weight |
|---|---|
| Si | 0.34 |
| Fe | 0.32 |
| Cu | 0.34 |
| Mn | 0.78 |
| Mg | 1.19 |
| Aluminum and Impurities | Balance |

The feedstock was processed in two steps. In the first step, the hot cast strip was hot rolled to 0.042 inches, quenched, and coiled with a coiling temperature below 500° F. In the second step, the feedstock was then rolled to 0.025 inches, flash annealed at 950° F., quenched, and final rolling to 0.0088 inches. After a 320° F. for 2 hours stabilizing treatment, the final gauge sheet had an ultimate tensile strength of 57,200 psi, a yield strength of 52,700 psi, and 7.4 elongation.

It will be understood that various changes in the details of procedure and formulation can be made without departing from the spirit of the invention, especially as defined in the following claims.

What is claimed is:

1. A method for making can end and tab stock comprising the steps of:

(a) continuous casting an aluminum alloy to form a feedstock;

(b) hot rolling the feedstock;

(c) quenching and coiling the feedstock;

(d) uncoiling and annealing the feedstock to effect recrystallization without causing substantial precipitation of alloying elements;

(e) quenching the feedstock;

(f) final rolling the feedstock to form a sheet; and (g) coiling the sheet at a temperature between 250° F. and 550° F.

2. The method in accordance with claim 1 wherein the hot rolling temperature is between 500° F. and the solidus temperature of the feedstock.

3. The method as defined in claim 2 wherein the sheet has a thickness between 0.0080 and 0.014 inches.

4. The method in accordance with claim 1 wherein the annealing of step (d) is at a temperature between 600° F. and 1100° F.

5. The method in accordance with claim 1 wherein the sheet is coiled in step (g) at a temperature between 300° F. and 475° F.

6. The method in accordance with claim 1 wherein the sheet is coiled in step (g) at a temperature between 250° F. and 450° F.

7. The method in accordance with claim 1 wherein the sheet is coiled in step (g) at a temperature between 300° F. and 500° F.

8. The method in accordance with claim 1 wherein the sheet is coiled in step (g) at a temperature between 300° F. and 450° F.

9. The method as defined in claim 1 further comprising the step of forming the sheet into a can end or a tab.

10. The method as defined in claim 1 wherein the feedstock is quenched in a separate step in addition to any quench that occurs during rolling.

11. The method as defined in claim 1 wherein the feedstock has a thickness of less than one inch after casting.

12. The method as defined in claim 1 wherein the continuous cast feedstock has a thickness between 0.07 and 0.12 inches.

13. The method as defined in claim 1 wherein the can end or tab stock contains 0.15 to about 0.5% by weight silicon, from 0.2 to about 0.5% by weight iron, from about 0.1 to about 0.6% by weight copper, about 0.5 to 1.2% by weight manganese, and about 0.5 to 2.0% by weight magnesium, with the balance being aluminum with its usual impurities.

14. The method as defined in claim 1 wherein the aluminum alloy is continuously cast by depositing molten aluminum between a pair of continuously moving metal belts.

15. The method as defined in claim 1 wherein the feedstock has a width less than 24 inches.

16. The method as defined in claim 1 wherein the aluminum alloy contains 0 to about 0.6% by weight silicon, from 0 to about 0.8% by weight iron, 0 to about 0.6% by weight copper, about 0.2 to 1.5% by weight manganese, and about 0.2 to 2% by weight magnesium, with the balance being aluminum with its usual impurities.

17. The method as defined in claim 1 wherein the aluminum alloy contains less than 2% magnesium.

18. The method as defined in claim 1 wherein the aluminum alloy contains 0.15 to about 0.5% by weight silicon, from 0.2 to about 0.5% by weight iron, from about 0.1 to about 0.6% by weight copper, about 0.5 to 1.2% by weight manganese, and about 0.5 to 2.0% by weight magnesium, with the balance being aluminum with its usual impurities.

19. The method in accordance with claim 1 further comprising rolling the sheet after it has been coiled in step (g).

20. The method in accordance with claim 1 further comprising forming the sheet into an end or tab.

21. A method for making end and tab stock for aluminum containers, comprising:

(a) continuous casting an aluminum alloy to form a feedstock;

(b) hot rolling the feedstock at a temperature between 500° F. and 1000° F.;

(c) quenching the feedstock by contacting with a cooling substance and coiling the feedstock;

(d) uncoiling the feedstock and annealing the feedstock at a temperature between 600° F. and 1100° F.;

(e) quenching the feedstock by contacting the feedstock with a cooling substance;

(f) final rolling the feedstock to form a sheet; and (g) coiling the sheet at a temperature between 300° F. and 475° F.

22. The method in accordance with claim 21 further comprising rolling the sheet after it has been coiled in step (g).

23. The method in accordance with claim 21 further comprising forming the sheet into an end or tab.

* * * * *